United States Patent [19]

Magnani

[11] Patent Number: 4,960,616

[45] Date of Patent: Oct. 2, 1990

[54] CORRUGATED ROOFING SHEETS OF SYNTHETIC FIBER-REINFORCED CEMENT, WITH A ROUGH SURFACE DUE TO THE PRESENCE OF GRANULAR MATERIAL

[75] Inventor: Sivio Magnani, Cannetp Pavese, Italy

[73] Assignee: CIF Compagnia Italiana Finanaziaria Spa, Italy

[21] Appl. No.: 464,566

[22] Filed: Jan. 16, 1990

Related U.S. Application Data

[63] Continuation of Ser. No. 208,482, Jun. 20, 1988, abandoned.

[30] Foreign Application Priority Data

Jul. 1, 1987 [IT] Italy ..... 21920[U]

[51] Int. Cl.[5] ..... B05D 1/06

[52] U.S. Cl. ..... 427/186; 427/204

[58] Field of Search ..... 427/186, 204

[56] References Cited

U.S. PATENT DOCUMENTS

| | | | |
|---|---|---|---|
| 1,868,803 | 7/1932 | Overbury . | |
| 1,890,023 | 12/1932 | Schroder | 427/204 X |
| 2,307,734 | 1/1943 | De Vault . | |
| 2,798,822 | 7/1957 | Carter | 427/186 |
| 2,818,824 | 1/1958 | Read et al. . | |
| 3,376,629 | 4/1968 | Baumann et al. | 427/204 |
| 3,862,527 | 1/1975 | Peterson . | |
| 4,145,860 | 3/1979 | Wotherspoon . | |
| 4,241,107 | 12/1980 | Mandish et al. | 427/204 |
| 4,529,625 | 7/1985 | Reidenbach et al. | 427/204 |

FOREIGN PATENT DOCUMENTS

| | | | |
|---|---|---|---|
| 361630 | 7/1929 | Belgium . | |
| 545108 | 2/1956 | Belgium . | |
| 2447286 | 4/1976 | Fed. Rep. of Germany . | |
| 2127468 | 10/1972 | France . | |
| 2389583 | 12/1978 | France . | |
| 516064 | 12/1939 | United Kingdom | 427/204 |
| 634793 | 3/1950 | United Kingdom | 427/204 |

*Primary Examiner*—Shrive Beck

*Attorney, Agent, or Firm*—Arnold, White & Durkee

[57] ABSTRACT

This invention relates to corrugated roofing sheets for buildings, made of a mixture of cement and inert materials, reinforced with synthetic fibers in fibrillated mesh form, characterized by having a rough outer surface due to the presence of surface granular material. The granular material is applied to the sheets during their finishing but before the cement has start to set, by simply strewing it over the sheet surface.

8 Claims, No Drawings

CORRUGATED ROOFING SHEETS OF SYNTHETIC FIBER-REINFORCED CEMENT, WITH A ROUGH SURFACE DUE TO THE PRESENCE OF GRANULAR MATERIAL

This is a Continuation of application Ser. No. 07/208,482 filed June 20, 1988 now abandoned.

PRIOR ART

Granular material is of known use in building components such as insulating sheets (French patent No. 2248384). Concrete components in the form of sheets with a rough surface and a vapour-impermeable film are also known (German patent No. 3022266), as are asbestos-cement sheets with granular material applied by pressing onto the surface of a cement layer superposed on the asbestos-cement (Japanese patent No. 53144926).

However, synthetic fiber-reinforced cement sheets with a rough surface for roofing use in buildings are as yet unknown, notwithstanding the widespread requirement for such roofing sheets with non-slip characteristics which do not contain asbestos.

SUMMARY OF THE INVENTION

We have now found it possible to produce corrugated self-supporting roofing sheets for buildings made of a cement and inert mixture reinforced with synthetic fibers, in nonfibrillated mesh form, and, the sheet having a rough surface due to the presence of surface granular material applied by simple strewing.

Said sheets are produced in known continuously operating plants, by: preparing a layer of suitable thickness of a mix of cement and water with sand and other inert materials, containing synthetic fibers in either fibrillated mesh, by either spraying the mix of cement and inert or allowing it to fall onto a felt or cloth band which advances continuously while supporting the fiber layer to be impregnated; strewing granular material over the surface of the layer before the cement starts to set; removing excess water from the layer by fixed or mobile suction boxes; and after the cement has set, brushing to remove from the surface those granules which have not been gripped by the cement.

The sheets of the present invention have functional and aesthetic characteristics which represent a considerable advance over components of the known art used for the same purpose, and their production cycle has advantageous aspects.

DETAILED DESCRIPTION OF THE INVENTION

This invention relates to corrugated or ribbed roofing sheets for buildings and the method for their production.

Said sheets are made of a cement and inert mixture reinforced with synthetic fibers which are characterized by possessing a rough outer surface due to the presence of surface granular material.

Said synthetic fibers are preferably polypropylene fibers in the form of a fibrillated or non-fibrillated mesh forms, and which have a much larger diameter than the asbestos fibers traditionally used in this field, namely between 15 and 120 microns compared with the diameters of asbestos fibers which are generally between 1 and 3 microns.

The granular material used for roughening the surface of the sheeting according to the present invention is preferably grit produced from mineral substances such as limestone, marble, silica, granite etc. by grinding and sieving to a particle size of between 0.1 and 4 mm and preferably between 0.5 and 1.5 mm. The material can also consist of glass beads of the same size. The granular material is applied to the sheet surface in a quantity of between 200 and 1500 g/m$^2$ and preferably between 500 and 1000 g/m$^2$.

The material is applied by distributing the granular material over the surface of the sheets during their finishing and before the cement has started to set. Thus, a layer of mix containing synthetic fibers is prepared to a thickness suitable for the sheet to be produced. The synthetic fibers are present to the extent of between 2.0 and 3.5% of the remaining solid material by weight.

The layer is prepared using a plant comprising a continuously advancing felt or cloth band on which the layer is deposited by free fall or spraying, to engage the fibers which have been previously deposited. The layer surface consists essentially of cement, sand and any other additives, the synthetic fibers remaining distanced far apart and embedded in the mass since they are both thick and spread out.

As the sheet advances it is subjected to known finishing operations such as smoothing. At this point the granular material is strewn over the sheet surface, which consists essentially of wet cement and any inert additives, before the cement has started to set, after which the normal operations such as removing any excess water by suction boxes, cutting and corrugating, placing on steel forms and stacking are continued. Specifically, water removal is continued until the residual water content is between 25 and 32% and preferably between 27 and 29% of the weight.

As the cement sets, it grips the granules with which it comes into contact. When the cement is completely set, the sheet surface is brushed to remove those material granules which have not been gripped by the cement. The sheet corrugation or ribbing profiles can be one of the known ranges corresponding, for example, to UNI 3949 177/6 or 146, ISO 691 or 692, or a different standard.

The sheets according to the invention have production, functional and aesthetic advantages compared with the known art. Their production process has, firstly, the advantage of comprising a simple and advantage is the following: the corrugated or ribbed sheets must be stacked with interposed plate steel forms between one sheet and the next in order to keep the shape of each sheet unaltered during setting of the cement. During this operation, if the synthetic fiber-reinforced sheets are not covered with granular material they will become scratched and marked at their points of contact with the plate steel forms, so that their final appearance will be deteriorated. This defect is inherent in components consisting of synthetic fiber-reinforced mixture of cement and inert materials because their surface consists essentially of cement. This does not, however, happen in the case of asbestos-cement since the asbestos reaches the surface to protect if from scratching. In the case of synthetic fiber-reinforced sheets without asbestos, the presence of the granular material makes the sheet surface insensitive to the action of the plate steel forms, so that the sheets according to the invention preserve a perfect surface.

The sheets according to the invention also have the following advantageous characteristics from a functional aspect:

when used directly as roofing sheets they obstruct the slippage of snow by virtue of the increased friction determined by the surface granular material;

when used as tile support sheets in which, when the roof is finished, their surface is not visible because it is covered by the tiles for which they act as a support, the increased friction between the sheet and tile prevents this latter slipping downwards. Furthermore, if the tiles are fixed by mortar, for example, to resist the underthrust of the wind, the mortar adheres better to the rough surface of the sheet so that fixing is more secure;

in the case of only slightly inclined pitches, where the horizontal superimposed parts have to be sealed with mastic, the mastic is more easily retained by the rough surface and, consequently, the seal lasts longer since it better resists small to-and-fro movements which the roof undergoes due to temperature and humidity variations;

there is a reduced risk of slippage of the load distribution boards which maintenance personnel lay on the roof when walking on it, or of slippage of the actual personnel if walking directly on the roof;

in drilling the sheets to take the screws or nails used to fix the ridge tiles, the time loss due to easy lateral slippage of the drill bit on commencing drilling is avoided because, when the drill bit touches the surface to be drilled, the roughness produces an initial guide sufficient to retain the bit in the required drilling position.

From an aesthetic aspect the sheets have the following advantageous characteristics;

absence of undersirable reflection by virtue of a non-shiny surface;

better colour uniformity due to the absence of reflection;

regular and uniform ageing of the surface, the appearance of which always remains uniform with time because the film which forms with age adheres uniformly to every point by virtue of the considerable surface roughness.

I claim;

1. A method of producing corrugated self supporting roofing sheets which consist essentially of a mixture of cement, inert materials and synthetic fiber reinforcement in mesh form, with a rough top surface of granular material, comprising the steps of:

preparing a mixture of cement, water and inert materials;

supporting synthetic fibers in mesh form on a continuously advancing felt or cloth band;

applying said mixture onto said mesh, forming a layer of suitable thickness which includes said mesh;

applying a granular material onto the top surface of said layer before the cement has set;

removing excess water from said layer;

corrugating said layer;

cutting said layer, thereby forming corrugated roofing sheets of desired length; and brushing the top surface of said sheets, after the cement has set, to remove unadhered granules of the granular material.

2. The method of claim 1, wherein the amount of synthetic fibers in said sheets is 2.0–3.5% by weight of the remaining solid material.

3. The method of claim 1, wherein said synthetic fibers are polypropylene fibers.

4. The method of claim 1, wherein said synthetic fibers have a diameter of 15–120 microns.

5. The method of claim 1, wherein said water removal is continued until the residual water content in said layer is 25–32% by weight.

6. The method of claim 1, wherein said granular material consists of mineral substances having a particle size of 0.5–1.5 mm in diameter.

7. The method of claim 1, wherein said granular material consists of limestone, marble, silica or granite.

8. The method of claim 1, wherein said granular material is applied to said top surface in a quantity of 500–1000 g/m$^2$.

* * * * *